US008657412B2

(12) United States Patent
Kim et al.

(10) Patent No.: US 8,657,412 B2
(45) Date of Patent: Feb. 25, 2014

(54) MICRO-EJECTION DEVICE

(75) Inventors: Sang Jin Kim, Gyunggi-do (KR); Bo Sung Ku, Gyunggi-do (KR)

(73) Assignee: Samsung Electro-Mechanics Co., Ltd., Suwon (KR)

( * ) Notice: Subject to any disclaimer, the term of this patent is extended or adjusted under 35 U.S.C. 154(b) by 0 days.

(21) Appl. No.: 13/358,345

(22) Filed: Jan. 25, 2012

(65) Prior Publication Data

US 2013/0083127 A1 Apr. 4, 2013

(30) Foreign Application Priority Data

Sep. 30, 2011 (KR) ..... 10-2011-0099781

(51) Int. Cl.
*B41J 2/14* (2006.01)

(52) U.S. Cl.
USPC ..... 347/47

(58) Field of Classification Search
USPC ..... 347/47
See application file for complete search history.

(56) References Cited

U.S. PATENT DOCUMENTS

| | | | | | |
|---|---|---|---|---|---|
| 3,451,730 | A * | 6/1969 | Thomas et al. | ..... | 384/18 |
| 4,144,830 | A * | 3/1979 | McPherren | ..... | 114/204 |
| 2011/0293452 | A1* | 12/2011 | Kim et al. | ..... | 417/472 |
| 2011/0316939 | A1* | 12/2011 | Kim et al. | ..... | 347/71 |
| 2012/0147097 | A1* | 6/2012 | Kim et al. | ..... | 347/71 |

FOREIGN PATENT DOCUMENTS

| | | | | | |
|---|---|---|---|---|---|
| JP | 2003-038966 | * | 2/2003 | ..... | B01L 3/02 |
| JP | 2003-38966 | A | 2/2003 | | |
| KR | 10-2005-0014780 | A | 2/2005 | | |
| KR | 10-2008-0098158 | A | 11/2008 | | |

* cited by examiner

*Primary Examiner* — Matthew Luu
*Assistant Examiner* — Michael Konczal
(74) *Attorney, Agent, or Firm* — McDermott Will & Emery LLP

(57) ABSTRACT

There is provided a micro-ejection device including: an ejector ejecting a fluid; and a body having an installation space in which the ejector is installed, wherein the installation space is provided with a guide unit inducing a line-contact or a point-contact between the ejector and the body.

6 Claims, 11 Drawing Sheets

MICRO-EJECTION DEVICE

CROSS-REFERENCE TO RELATED APPLICATIONS

This application claims the priority of Korean Patent Application No. 10-2011-0099781 filed on Sep. 30, 2011, in the Korean Intellectual Property Office, the disclosure of which is incorporated herein by reference.

BACKGROUND OF THE INVENTION

1. Field of the Invention

The present invention relates to a micro-ejection device, and more particularly, to a micro-ejection device capable of reducing a micro-ejector abrasion phenomenon due to frequent installations and removals of a micro-ejector.

2. Description of the Related Art

Biotechnology, among highly advanced modern state-of-the-art technologies, has been recently prominent. Biotechnology uses many samples related to the life of living things, either directly or indirectly. A micro-fluidic system for transporting, controlling, analyzing, etc. a fluid (in particular, a micro-fluidic sample dissolved in a medium) is indispensable to the field of biotechnology.

The micro-fluidic system is manufactured based on micro-electro mechanical system (MEMS) technology. Such a micro-fluidic system has been used in a wide variety of application fields, such as the injection of a drug or a bioactive material into a body, a lab-on-a-chip, a chemical analysis for the development of a new drug, inkjet printing, a small-sized cooling system, a small-sized fuel cell, and the like. A micro-ejection device is one of MEMS devices used in the fields stated above.

The micro-ejection device includes a plurality of ejectors for absorbing or ejecting samples. The ejector may have a long tube shape such that a small amount of samples may be absorbed thereinto or ejected therefrom, and may be installed in and removed from the micro-ejection device.

In general, an operation of installing or removing the ejector in or from the micro-ejection device needs to be repeatedly performed in order to obtain accurate drug test results from a sample. However, since the ejector is manufactured using a material having relatively low rigidity, as compared to the micro-ejection device, the ejector may be easily damaged during the installing or removing of the ejector in or from the micro-ejection device.

Therefore, a development of the ejector that is not easily damaged even in a case in which the ejector is repeatedly installed in or removed from the micro-ejection device or the micro-ejection device having the ejector is required.

SUMMARY OF THE INVENTION

An aspect of the present invention provides a micro-ejection device capable of reducing a damage phenomenon that occurs during a process of installing or removing an ejector in or from the micro-ejection device.

According to an aspect of the present invention, there is provided a micro-ejection device, including: an ejector ejecting a fluid; and a body having an installation space in which the ejector is installed, wherein the installation space is provided with a guide unit inducing a line-contact or a point-contact between the ejector and the body.

The guide unit may have a curved shape such that the guide unit line-contacts the ejector.

The guide unit may have a hemispherical shape or spherical shape such that the guide unit point-contacts the ejector.

The guide unit may be a roller rotatably installed in the body.

The guide unit may be formed of a material softer than that of the ejector in order to prevent the ejector from being abraded due to frictional contact between the ejector and the guide unit.

The guide unit may be formed of a natural rubber or a synthetic resin material.

The body may include an arrangement unit arranging a location of the ejector.

The arrangement unit may include a first inclined surface.

The arrangement unit may have a triangular or trapezoidal shape.

The ejector may include a second inclined surface corresponding to the first inclined surface.

The arrangement unit may include an extension unit not in contact with the ejector.

BRIEF DESCRIPTION OF THE DRAWINGS

The above and other aspects, features and other advantages of the present invention will be more clearly understood from the following detailed description taken in conjunction with the accompanying drawings, in which.

DETAILED DESCRIPTION OF THE INVENTION

Hereinafter, embodiments of the present invention will be described in detail with reference to the accompanying drawings.

In describing the present invention below, terms indicating components of the present invention are named in consideration of the functions thereof. Therefore, the terms used herein should not be understood as limiting technical components of the present invention.

A micro-ejection device may include a plurality of ejectors that may be repeatedly installed therein and removed therefrom in order to perform an operation of taking or ejecting a sample. However, since the ejector has a relatively low rigidity compared to a body of the micro-ejection device, the ejector may be easily abraded due to repeated installations and removals thereof.

Such an abrasion phenomenon of the ejector may cause damage to the ejector, and a precision of a location in which the ejector is installed with respect to the body of the micro-ejection device deteriorates. Thus, a development of a micro-ejection device capable of reducing an abrasion of the ejector is required.

To solve this defect, the present invention may provide a structure of a micro-ejection device, which is capable of remarkably reducing contact friction between a body of the micro-ejection device and an ejector.

Figure 1:
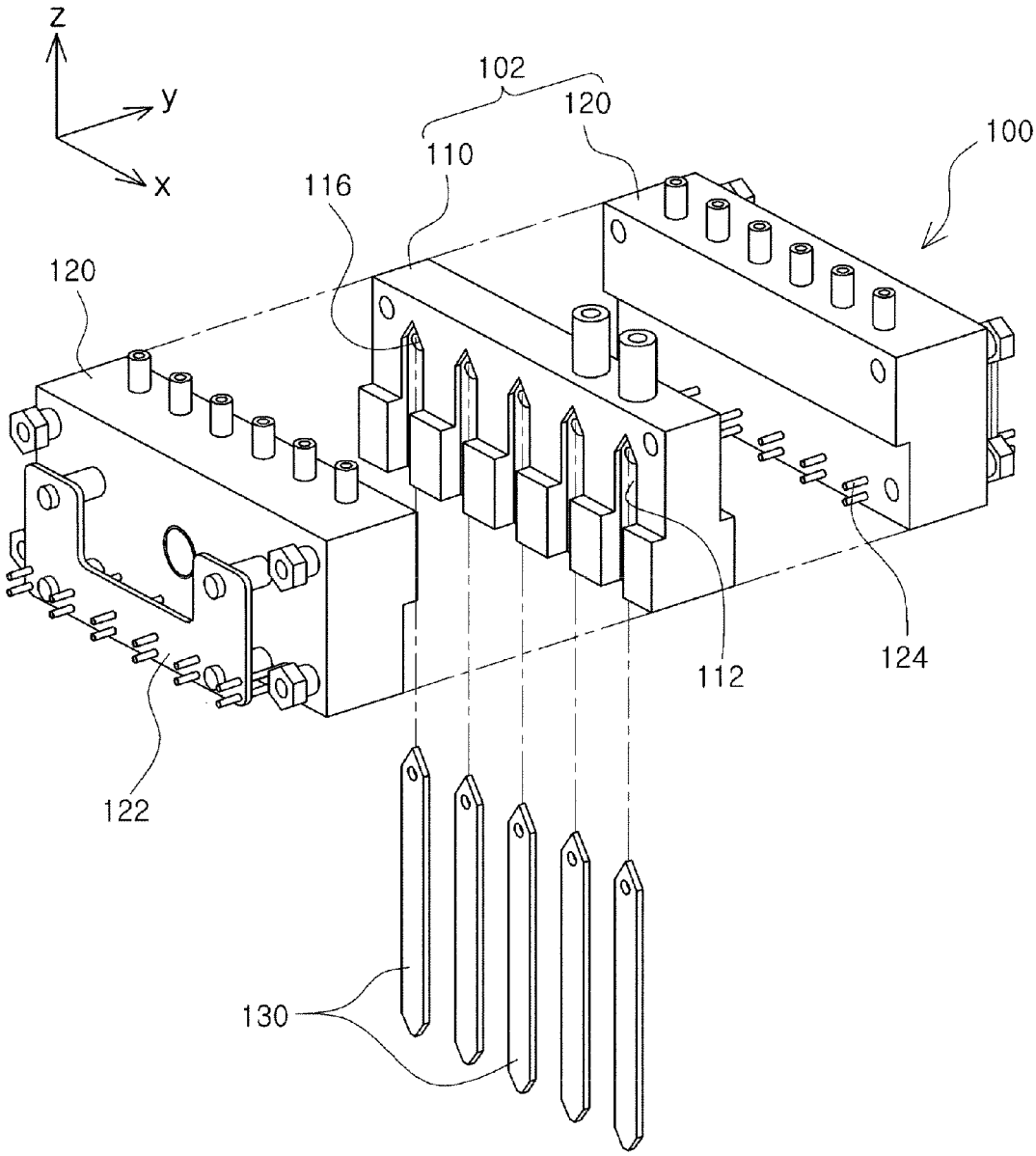
FIG. 1 is an exploded perspective view of a micro-ejection device according to a first embodiment of the present invention.
Figure 2:
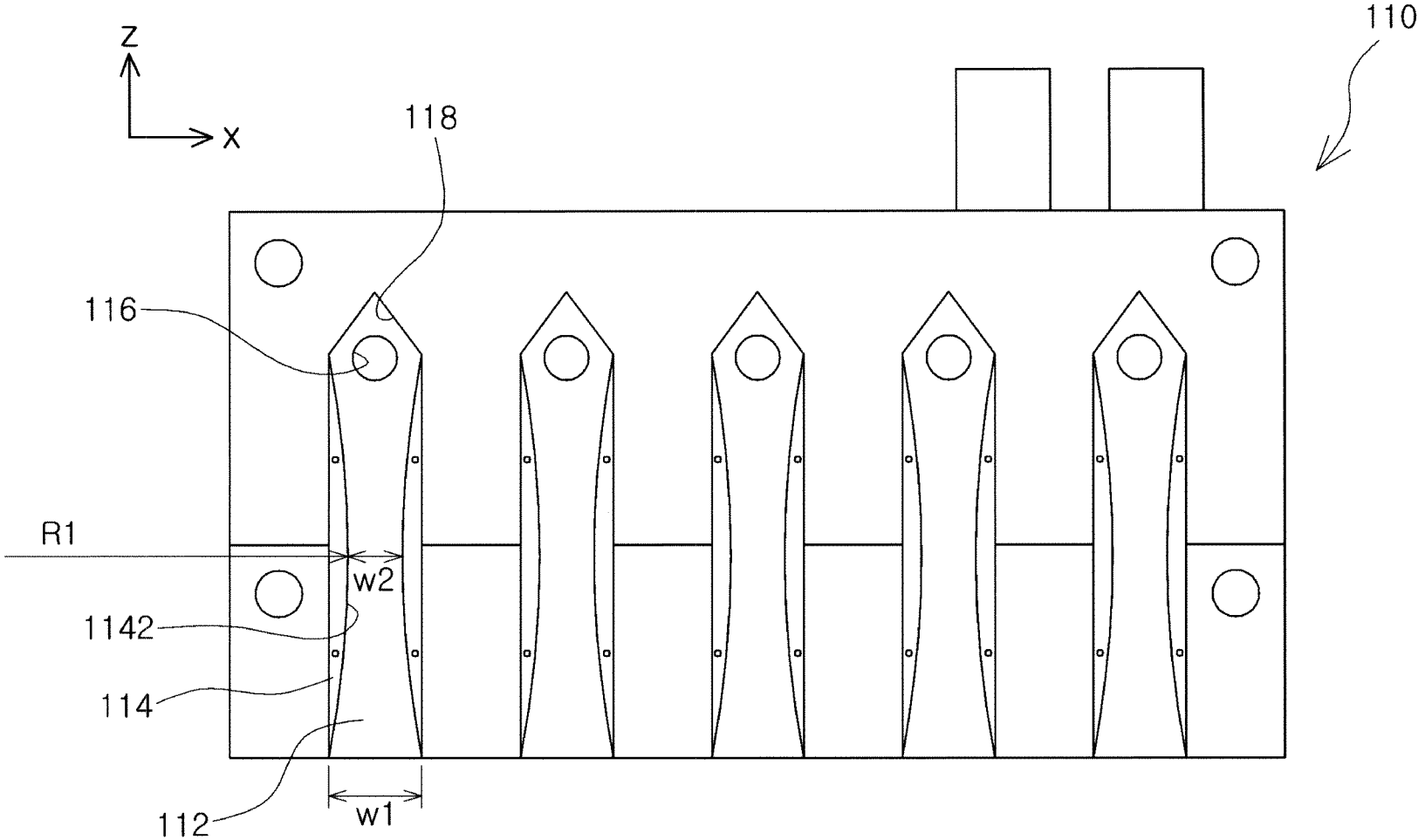
FIG. 2 is a front view of a body of the micro-ejection device shown in FIG. 1.
Figure 3:
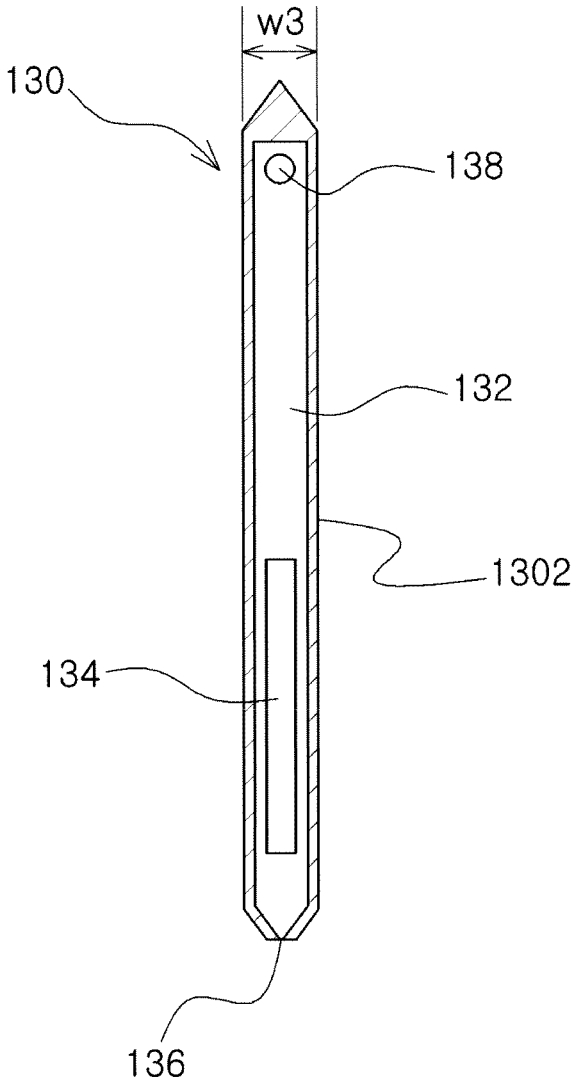
FIG. 3 is a cross-sectional view of an ejector shown in FIG. 1.
Figure 4:
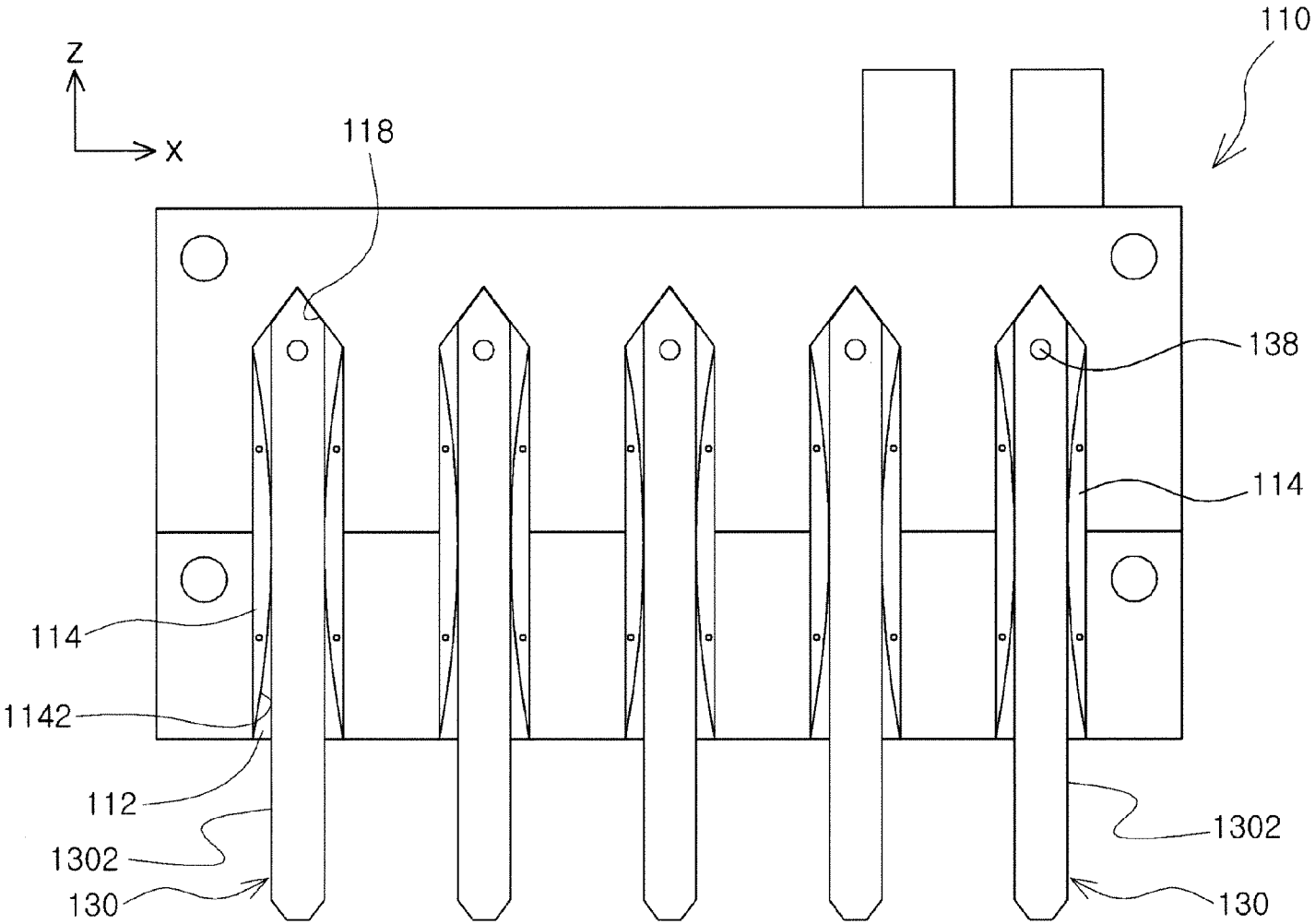
FIG. 4 is a view of a status in which an ejector is installed in the body of the micro-ejection device shown in FIG. 2.
Figure 5:
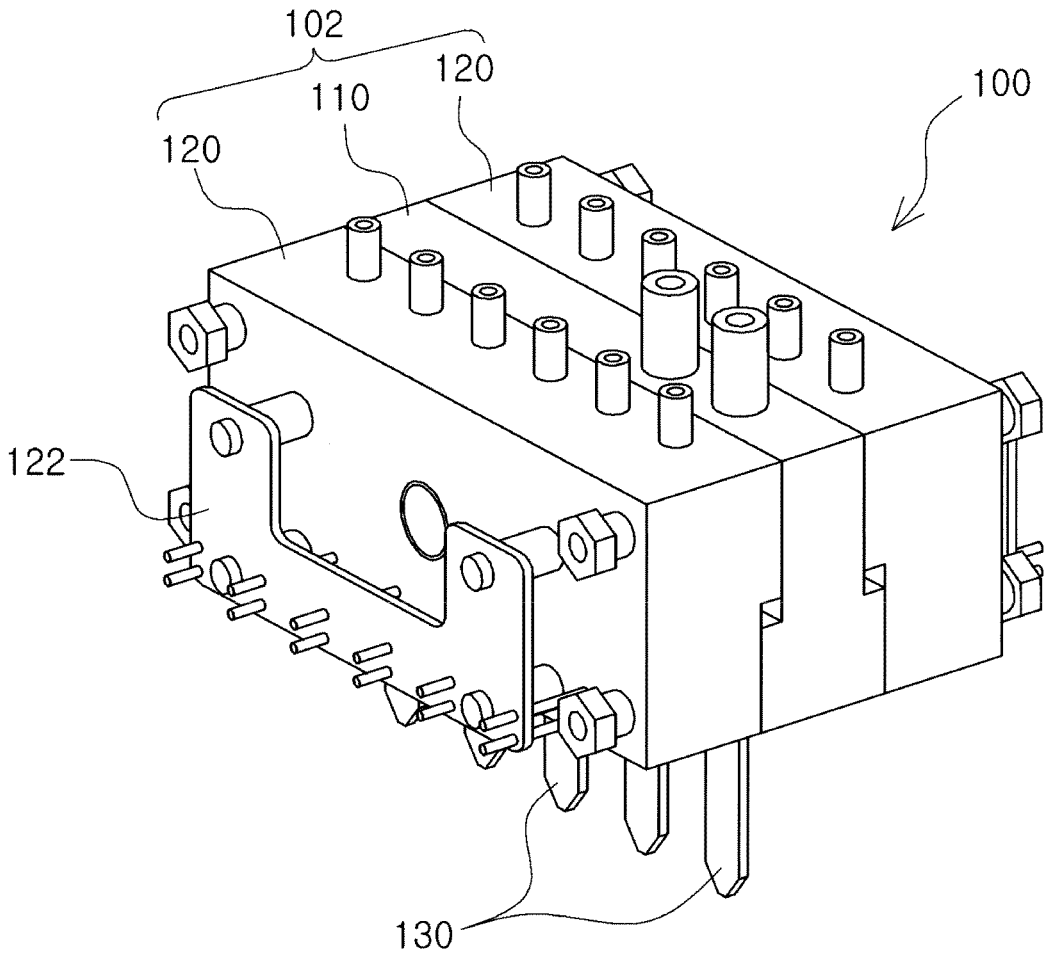
FIG. 5 is a coupling perspective view of the micro-ejection device shown in FIG. 1.
Figure 10:
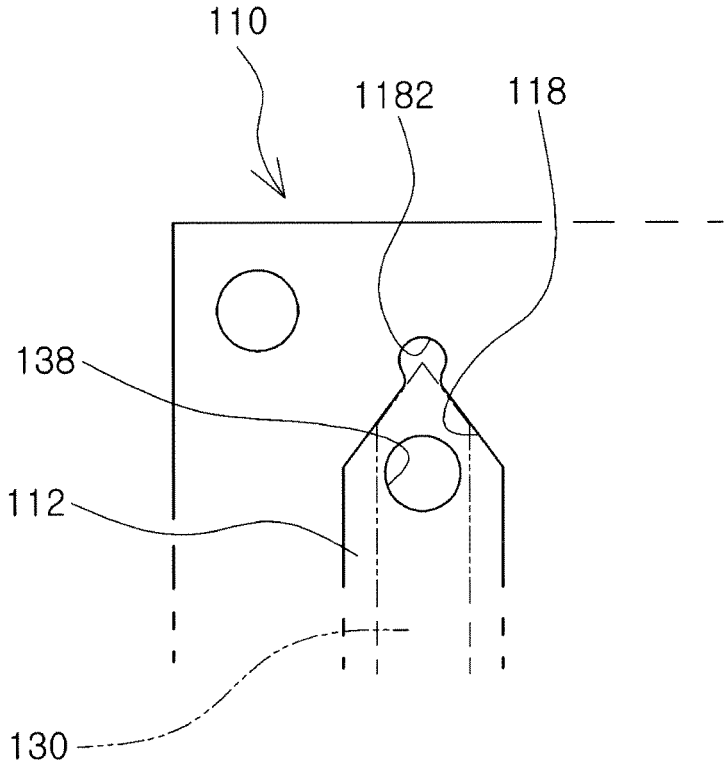
FIGS. 10 and 11 are views of modifications of an arrangement unit.
Figure 11:
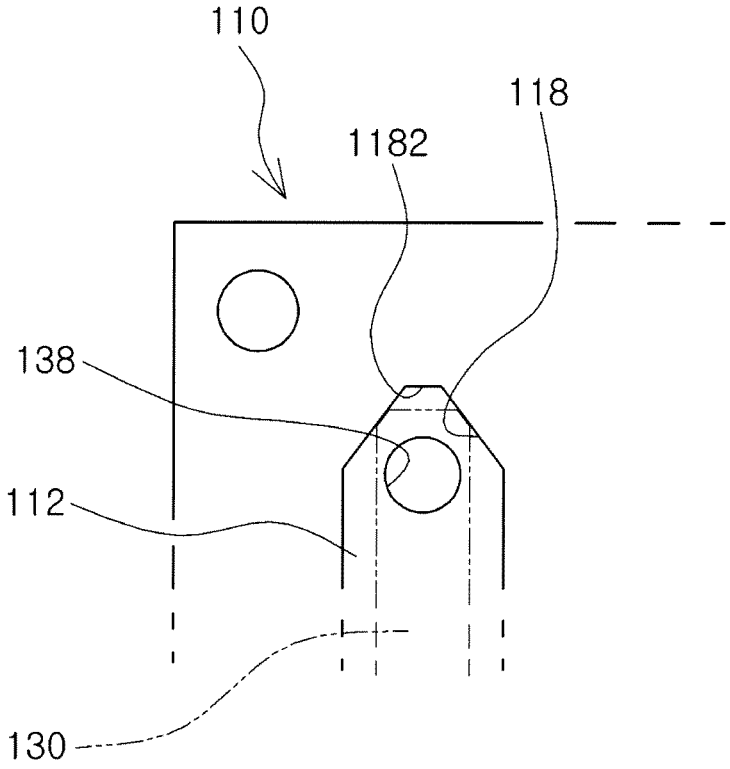

A general structure of a micro-ejection device and the structural characteristics thereof, capable of reducing an abrasion phenomenon of an ejector will be described below. FIG. 1 is an exploded perspective view of a micro-ejection device according to a first embodiment of the present invention. FIG. 2 is a front view of a body of the micro-ejection device shown in FIG. 1. FIG. 3 is a cross-sectional view of an ejector shown in FIG. 1. FIG. 4 is a view of a status in which an ejector is installed in the body of the micro-ejection device shown in FIG. 2. FIG. 5 is a coupling perspective view of the micro-ejection device shown in FIG. 1. FIGS. 10 and 11 are views of modifications of an arrangement unit.

First Embodiment

A micro-ejection device 100 according to the embodiment may include a body 102 of the micro-ejection device 100 and an ejector 130. In this case, the body 102 may form an overall exterior shape of the micro-ejection device 100 and include a first body 110 and at least one second body 120.

The first body 110 may include an installation unit 112. The installation unit 112 may be formed in front and rear surfaces of the first body 110 by a certain space along a length direction (X axial direction) of the first body 110. In this case, a width W1 of the installation unit 112 may be greater than a width W3 (see FIG. 3) of the ejector 130. Thus, in general, a side surface of the installation unit 112 may not contact a side surface 1302 of the ejector 130.

As shown in FIG. 2, guide units 114 may be attached or fixed to the installation unit 112. More specifically, the guide units 114 may be fixed to both side surfaces of the installation unit 112 and may be fixed to and separated from the installation unit 112. For example, the guide units 114 may be fixed to the installation unit 112 via a pin, bolt, or the like, which may be easily coupled. The guide units 114 may include contact surfaces 1142, each contact surface contacting the side surface 1302 of the ejector 130. In this case, the contact surfaces 1142 may have a curved shape having a radius R1. A minimum distance W2 between the contact surfaces 1142 facing each other may be equal to or smaller than the width W3 of the ejector 130. The guide units 114 may contact the ejector 130 to allow the ejector 130 to be fixed to the installation unit 112. However, since each of the guide units 114 according to the embodiment has a curved shape, the guide units 114 may not surface-contact but rather line-contact the ejector 130. According to the embodiment, since friction surfaces between the guide units 114 and the ejector 130 are relatively small as compared to the case of the related art, an abrasion phenomenon of the ejector 130 may be remarkably reduced.

The guide units 114 may be formed of a relatively soft material compared to the ejector 130 in order to further reduce the abrasion phenomenon of the ejector 130. For example, the guide units 114 may be formed of a material such as a natural rubber, a synthetic resin, or the like. If the guide units 114 are formed of an elastically soft material, the fixation of the ejector 130 may be facilitated and the abrasion phenomenon of the ejector 130 may be remarkably reduced.

Meanwhile, frequent installations and removals of the ejector 130 may cause a predetermined friction between the ejector 130 and the guide units 114, even though the ejector 130 is small. In this case, since the guide units 114 are formed of a relatively soft material as compared to that of the ejector 130 as described above, such friction may cause a partial abrasion phenomenon of the guide units 114 (in particular, the contact surfaces 1142).

However, according to the present embodiment, since an abrasion of the contact surfaces 1142 may increase the minimum distance W2 between the contact surfaces 1142 to thereby lead to difficulty in the fixation of the ejector 130 due to the contact surfaces 1142, it is possible to prevent the ejector 130 from being installed in an incorrect location, in advance.

An outlet 116 may be formed in the installation unit 112, the outlet 116 being connected to the ejector 130. The outlet 116 may be used as an exit of fluid supplied to the first body 110 to thereby supply the fluid to the ejector 130. For reference, the outlet 116 may be connected to a flow path 132 of the ejector 130.

In addition, the installation unit 112 may be provided with an arrangement unit 118. The arrangement unit 118 may have at least one inclined surface and may have a triangular shape, as shown in FIG. 2. In this case, an edge part of the ejector 130 may have at least one inclined surface corresponding to the arrangement unit 118 and may have a triangular shape as shown in FIG. 3. Since the arrangement unit 118 may have a shape corresponding to that of the edge part of the ejector 130, locations of the arrangement unit 118 and the ejector 130 are corrected, and thus, an installation location of the ejector 130 with respect to the installation unit 112 may be maintained constant.

Meanwhile, the arrangement unit 118 may be modified to have a shape as shown in FIGS. 10 and 11. If the arrangement unit 118 is formed to have the triangular shape as described above, the ejector 130 may be easily arranged. However, it may be disadvantageous in that the shapes of the arrangement unit 118 and the ejector 130 need to be exactly consistent with each other.

In consideration of this, an extension unit 1182 may be formed in an apex portion of the arrangement unit 118 as shown in FIGS. 10 and 11. The extension unit 1182 formed in the apex portion of the arrangement unit 118 may be advantageous, in that the extension unit 1182 may allow for the arrangement of the ejector 130 even in a case in which the inclined surface of the arrangement unit 118 and the inclined surface of the ejector 130 are not entirely adhered to each other, and allow for the easy processing of the arrangement unit 118.

The at least one second body 120 may include power applying substrates 122 and connection pins 124. The power applying substrates 122 may be installed on the second body 120. The power applying substrates 122 may be connected to an external device, and may generate a predetermined level of current or voltage. The connection pins 124 may be formed in a surface of the second body facing the first body 110. The connection pins 124 connected to one power applying substrate 122 installed on one surface of the second body 120 may be connected to another power applying substrate 122 installed on the other surface (opposite surface) of the second body 120, and may transfer a predetermined level of current or voltage generated by the power applying substrates 122 to the ejector 130.

For reference, the first body 110 and the second body 120 may be coupled to each other by using an engagement member such as a bolt and a nut.

In general, the ejector 130 may have a thin and long shape and absorb or eject a small amount of fluid. The ejector 130 may be removably installed in the first body 110 and eject a fluid in a micro-unit. A detailed configuration of the ejector 130 is described with reference to FIG. 3.

The ejector 130 may include the flow path 132 through which a fluid moves therein, as shown in FIG. 3. An inlet 138 into which the fluid is introduced may be formed in one end of the flow path 132, and a nozzle 136 from which the fluid is ejected may be formed in the other thereof. A piezoelectric device 134 including lead zirconate titanate (PZT) may be installed in the flow path 132 as a driving means for ejecting the fluid stored in the flow path 132 to the outside of the nozzle 136.

The ejector 130 as described above, may receive the fluid through the inlet 138 and store the fluid in the flow path 132. If the piezoelectric device 134 operates according to an external signal, the ejector 130 may eject the fluid in the flow path 132 to the outside, through the nozzle 136. An upper distal end of the ejector 130 may have a pointed shape as shown in FIG. 3. The pointed shape may be very advantageous to precisely arrange the ejector 130 in the center of the installation unit 112.

Meanwhile, since the shape of the ejector 130 shown in FIG. 3 is merely exemplary, the shape may be different according to a use field of the micro-ejection device 100. For example, the ejector 130 may include a silicon on insulator (SOI) wafer, in which an insulating layer is formed between two silicon layers or may include at least one substrate. The flow path 132 may be formed by dry-etching or wet-etching a substrate.

The piezoelectric device 134 may be formed on an upper surface of the substrate so as to correspond to a pressure chamber, and may include a lower electrode that serves as a common electrode, a piezoelectric layer modified according to an application of voltage, and an upper electrode that serves as a driving electrode.

The lower electrode may be formed on an overall surface of the substrate, and may be formed of a single conductive metal material. For example, the lower electrode may include two metal thin layers formed of titanium (Ti) and platinum (Pt). The lower electrode may serve as an anti-diffusion layer that prevents diffusion between the piezoelectric layer and the substrate as well as serving as the common electrode.

The piezoelectric layer is formed on the lower electrode and is located on an upper portion of the piezoelectric chamber. The piezoelectric layer may be formed of a piezoelectric material, for example, a PZT ceramic material. The upper electrode is formed on the piezoelectric layer and may be formed of any one of materials such as Pt, Au, Ag, Ni, Ti, and Cu.

The micro-ejection device 100 has a small contact surface between the first body 110 and the ejector 130 as described above, thereby remarkably reducing the abrasion phenomenon of the ejector 130 due to the installations and removals of the ejector 130.

Meanwhile, frequent installations and removals of the ejector 130 may cause a predetermined friction between the ejector 130 and the guide units 114 even though the ejector 130 is small. In this case, since the guide units 114 are formed of a relatively soft material compared to the ejector 130 as described above, such friction may cause a partial abrasion phenomenon of the guide units 114 (in particular, the contact surfaces 1142).

However, according to the embodiment, since the abrasion of the contact surfaces 1142 may increase the minimum distance W2 between the contact surfaces 1142 to thereby lead to difficulty in the fixation of the ejector 130 due to the contact surfaces 1142, it is possible to prevent the ejector 130 from being installed in an incorrect location, in advance.

Another embodiment of the present invention will now be described with reference to FIGS. 6 to 9 below.

Figure 6:
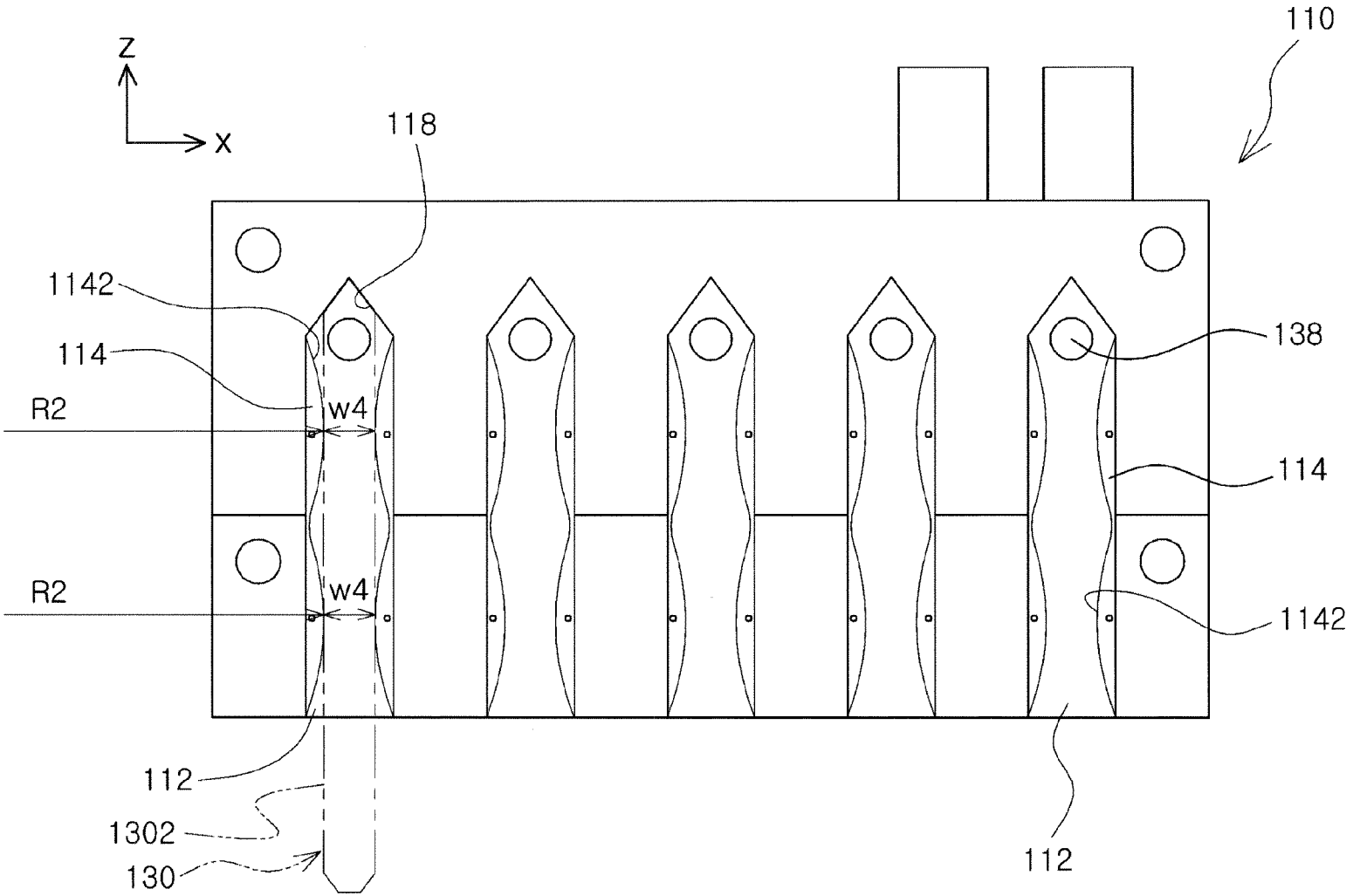
FIG. 6 is a front view of a body of a micro-ejection device according to a second embodiment of the present invention.
Figure 7:
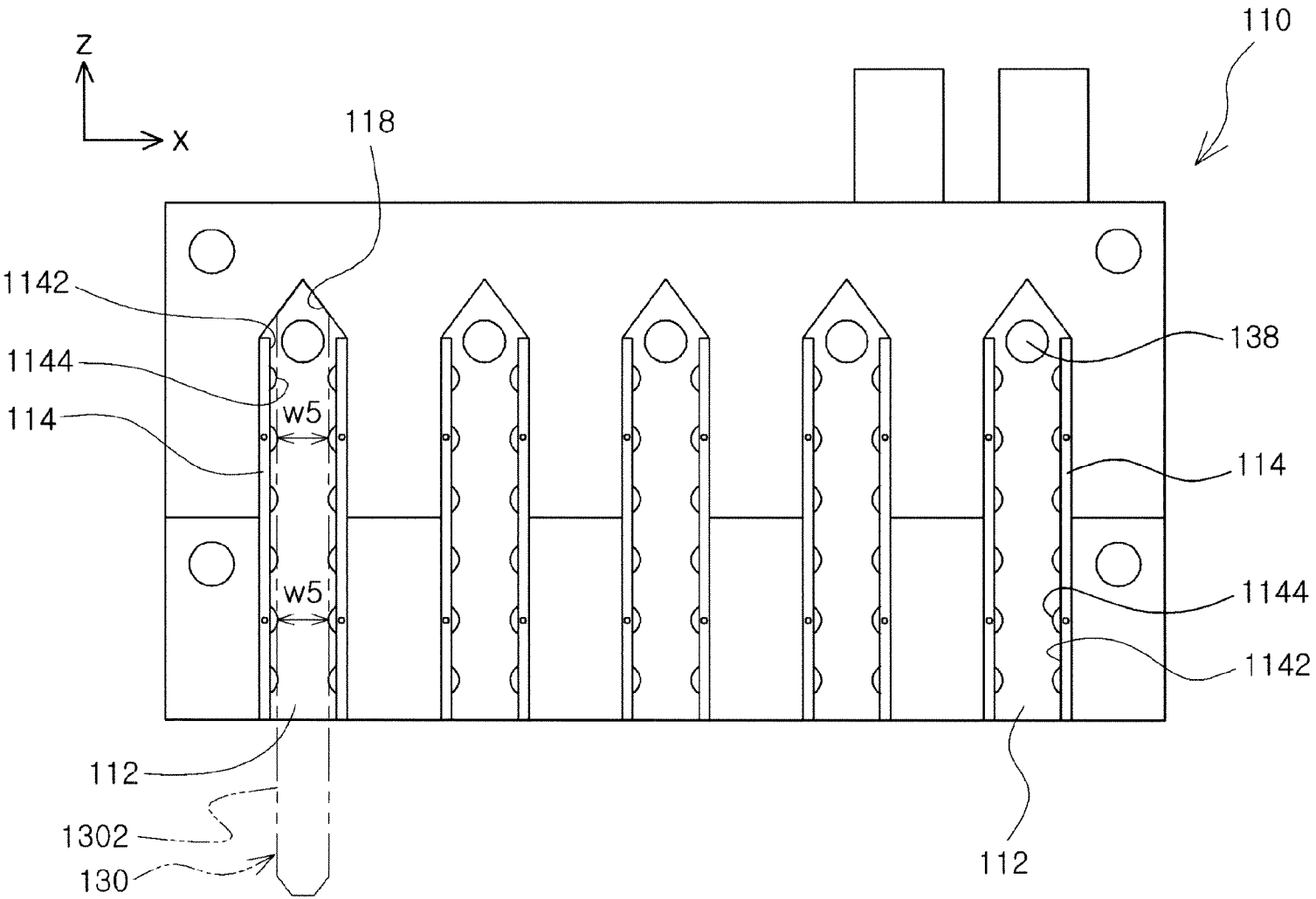
FIG. 7 is a front view of a body of a micro-ejection device according to a third embodiment of the present invention.
Figure 8:
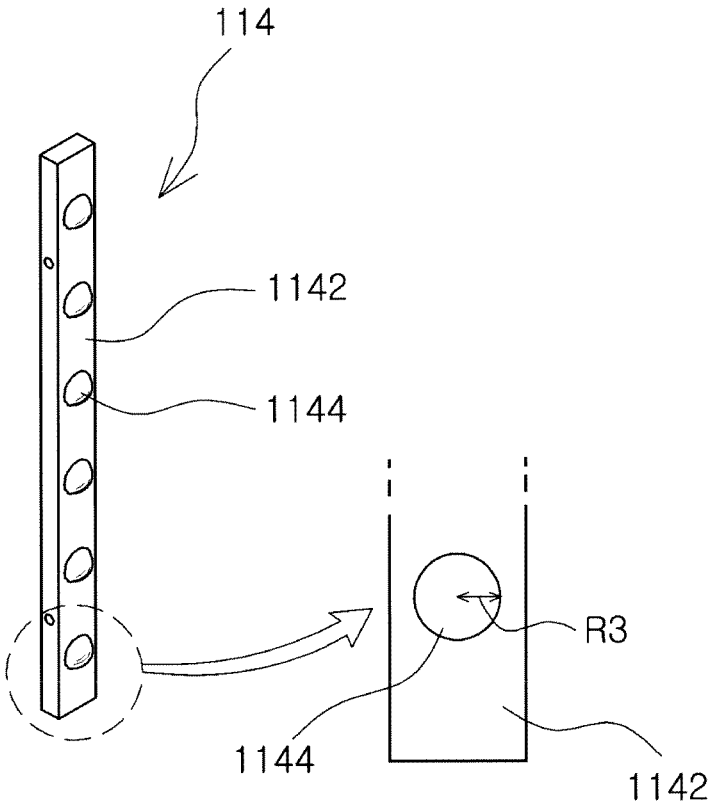
FIG. 8 is a perspective view of a guide unit shown in FIG. 7.
Figure 9:
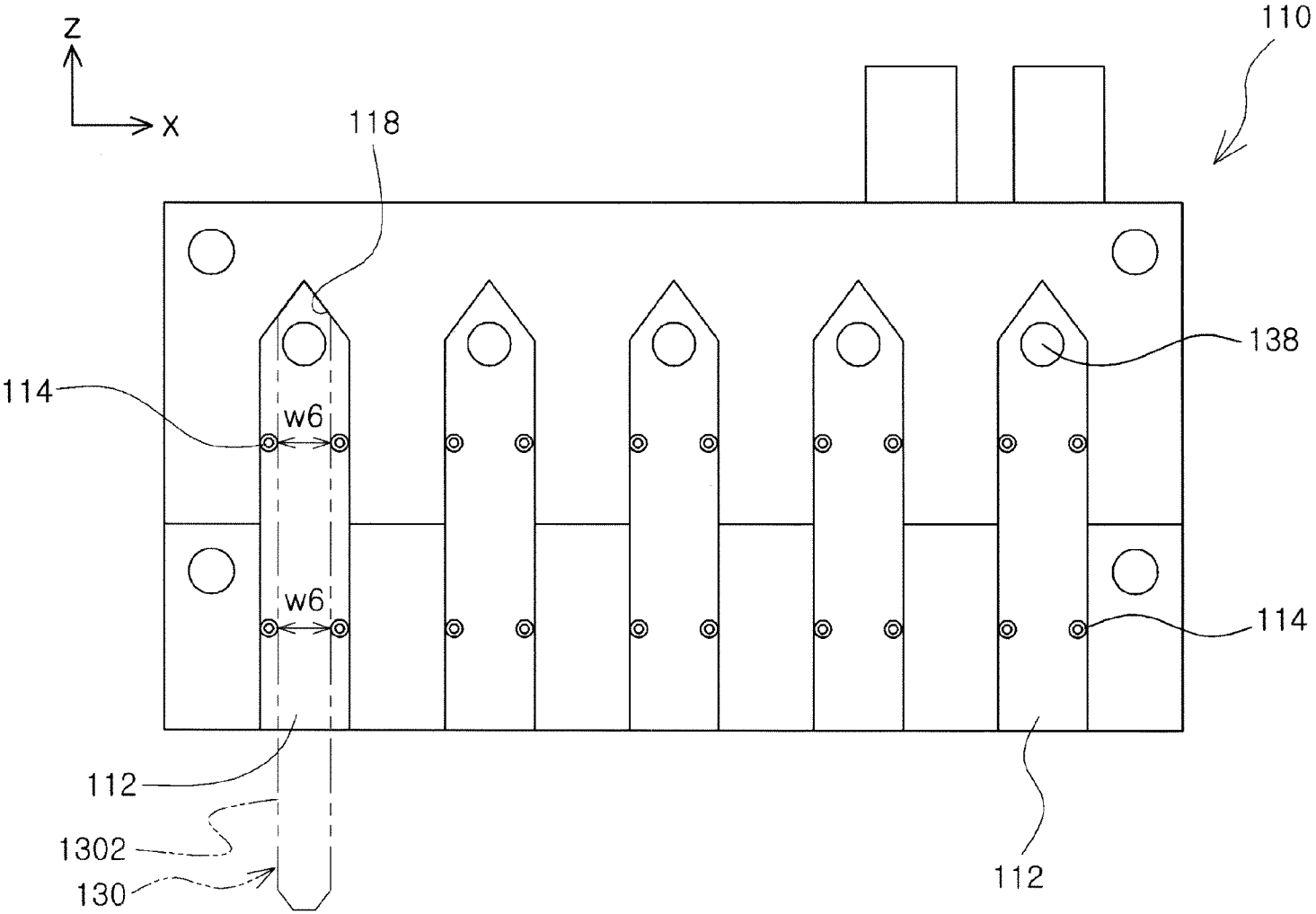
FIG. 9 is a front view of a body of a micro-ejection device according to a fourth embodiment of the present invention.

FIG. 6 is a front view of a body of a micro-ejection device according to a second embodiment of the present invention. FIG. 7 is a front view of a body of a micro-ejection device according to a third embodiment of the present invention. FIG. 8 is a perspective view of a guide unit shown in FIG. 7. FIG. 9 is a front view of a body of a micro-ejection device according to a fourth embodiment of the present invention.

Second Embodiment

The micro-ejection device 100 according to the second embodiment is different from the micro-ejection device 100 according to the first embodiment in terms of the shape of the guide units 114.

Each of the guide units 114 according to the embodiment may have a plurality of curved surfaces as shown in FIG. 6. That is, the contact surface 1142 of each guide unit 114 may have curve surfaces having the same radius R2 or different radii. In this regard, a minimum distance W4 between the contact surfaces 1142 facing each other may be equal to or smaller than the width W3 of the ejector 130 as described in the first embodiment. Meanwhile, two points forming the minimum distance W4 may have a predetermined distance maintained therebetween. This may be useful in increasing a fixing effect of the ejector 130 with respect to the contact surfaces 1142.

The micro-ejection device 100 may increase a fixing force of the ejector 130 with respect to the guide units 114 because a line contact between the guide units 114 and the ejector 130 may take place in more than two points.

Third Embodiment

The micro-ejection device 100 according to the third embodiment is different from those of the foregoing embodiments in that the guide units 114 and the ejector 130 have a point-contact structure.

The guide units 114 according to the embodiment may be a thin plate shape as shown in FIGS. 7 and 8 and include a plurality of projections 1144. That is, in the embodiment, the guide units 114 may include the plurality of projections 1144 on the contact surfaces 1142 facing each other. The projections 1144 may have a hemispherical shape having a radius R3 such that the guide unit 114 may point-contact the ejector 130. Alternatively, parts of the projections 1144 contacting the ejector 130 may individually have a spherical surface. The projections 1144 may be formed at a certain distance in a length direction and in a width direction of the guide unit 114. In this regard, the interval between the projections 1144 and the number of the projections 1144 may be increased and reduced as needed. For example, if it is necessary to increase the fixing effect of the ejector 130 with respect to the projections 1144, the number of the projections 1144 may be increased and the interval between the projections 1144 may be reduced. If it is necessary to reduce a contact surface between the projections 1144 and the ejector 130, the number of the projections 1144 may be reduced and the interval between the projections 1144 may be increased. Meanwhile, a minimum distance W5 between the projections 1144 formed in the guide units 114 facing each other may be equal to or smaller than the width W3 of the ejector 130.

In the embodiment, the guide units 114 and the ejector 130 may contact each other through a point-contact as described above, thereby remarkably reducing the abrasion phenomenon of the ejector 130 with respect to the guide units 114.

In the embodiment, the guide units 114 and the ejector 130 have a relatively very small contact surface, thereby easily performing installations and removals of the ejector 130 with a small amount of force.

Fourth Embodiment

The micro-ejection device 100 according to the fourth embodiment is different from those of the foregoing embodiments in terms of the shape of the guide units 114.

The guide units 114 according to the embodiment may have a roller shape as shown in FIG. 9. The guide units 114 each having the roller shape may be rotatably installed in the installation unit 112. A minimum distance W6 between the guide units 114 facing each other may be equal to or smaller than the width W3 of the ejector 130. In this regard, a surface of each guide units 114 may have a roller shape coated with rubber or synthetic resin.

Meanwhile, when all of the guide units 114, each in the roller shape are rotatably installed, the fixation of the ejector 130 with respect to the guide units 114 may be difficult. Therefore, only one of two pairs of the guide units 114 may be rotatably installed.

In the embodiment, the guide units 114 may rotate in an installation direction or a removal direction of the ejector 130, thereby allowing for easy installing and removing of the ejector 130.

As set forth above, according to embodiments of the invention, since a contact surface between a body of a micro-ejection device and an ejector is small, the ejector can be easily installed in the body of the micro-ejection device.

Further, since the contact surface between the body of the micro-ejection device and the ejector is small, an abrasion phenomenon of the ejector due to frequent installations and removals of the ejector can be remarkably reduced.

While the present invention has been shown and described in connection with the embodiments, it will be apparent to those skilled in the art that modifications and variations can be made without departing from the spirit and scope of the invention as defined by the appended claims.

What is claimed is:

1. A micro-ejection device comprising:

an ejector ejecting a fluid; and a body having an installation space in which the ejector is installed and an arrangement unit arranging a location of the ejector, wherein:

the installation space is provided with a guide unit inducing a line-contact or a point-contact between the ejector and the body, the arrangement unit includes a first inclined surface and the ejector includes a second inclined surface corresponding to the first inclined surface, and the arrangement unit includes an extension unit not in contact with the ejector.

2. The device of claim 1, wherein the guide unit has a curved shape such that the guide unit line-contacts the ejector.

3. The device of claim 1, wherein the guide unit has a hemispherical shape or spherical shape such that the guide unit point-contacts the ejector.

4. The device of claim 1, wherein the guide unit is a roller rotatably installed in the body.

5. The device of claim 1, wherein the guide unit is formed of a material softer than that of the ejector in order to prevent the ejector from being abraded due to frictional contact between the ejector and the guide unit.

6. The device of claim 5, wherein the guide unit is formed of a natural rubber or a synthetic resin material.

* * * * *